US006753773B2

(12) United States Patent
Mizuno

(10) Patent No.: US 6,753,773 B2
(45) Date of Patent: Jun. 22, 2004

(54) VEHICLE COMMUNICATION DEVICE HAVING SWITCHABLE OPERATION MODE AND RADIO WAVE INTENSITY CHECKING DEVICE

(75) Inventor: Tomoaki Mizuno, Toyoake (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/852,702

(22) Filed: May 11, 2001

(65) Prior Publication Data

US 2002/0021227 A1 Feb. 21, 2002

(30) Foreign Application Priority Data

May 19, 2000 (JP) ..... 2000-147997

(51) Int. Cl.[7] ..... G08B 29/00

(52) U.S. Cl. ..... 340/514; 340/515; 340/539.1; 340/539.21; 340/905; 340/933; 340/928

(58) Field of Search ..... 340/514, 515, 340/539.1, 539.21, 825.43, 825.71, 825.77, 909, 933; 342/22

(56) References Cited

U.S. PATENT DOCUMENTS 5,760,709 A * 6/1998 Hayashi ..... 340/928
6,191,705 B1 * 2/2001 Oomen et al. ..... 340/905
6,337,622 B1 * 1/2002 Sugano ..... 340/438

FOREIGN PATENT DOCUMENTS

JP 09-198535 7/1997
JP 11-298489 10/1999

* cited by examiner

*Primary Examiner*—Daryl Pope
(74) *Attorney, Agent, or Firm*—Posz & Bethards, PLC

(57) ABSTRACT

A vehicle communication device is installed in a vehicle and used for an ETC or other DSRC system. The vehicle communication device can be switched between a normal mode and a radio wave emitting mode. The vehicle communication device in the normal mode transmits a response signal in response to receiving a pilot signal from a roadside radio device. The vehicle communication device in the emitting mode continuously emits a radio wave through the windshield of the vehicle independently of whether it receives the pilot signal from the roadside radio device, and a checking device receives the radio wave. The checking device determines whether the intensity of the received radio wave is greater than a predetermined threshold. The result of the determination is reported to a staff in a service or repair shop so that a shop staff can determine whether the vehicle communication device can be used for the ETC or other DSRC system based on the reported result.

14 Claims, 2 Drawing Sheets

VEHICLE COMMUNICATION DEVICE HAVING SWITCHABLE OPERATION MODE AND RADIO WAVE INTENSITY CHECKING DEVICE

CROSS REFERENCE TO RELATED APPLICATION

This application is based on and incorporates herein by reference Japanese Patent Application No. 2000-147997 filed on May 19, 2000.

BACKGROUND OF THE INVENTION

1. Field of the Invention

The present invention relates to a vehicle communication device capable of communicating using a Dedicated Short-Range Communication (DSRC) radio system and to a device for checking the intensity of a radio wave emitted from the vehicle communication device through a windshield.

2. Related Art

The DSRC radio system is proposed in ARIB STD-T55 by Association of Radio Industries and Businesses (ARIB) as a standard for narrow area radio communication between a vehicle and a roadside device, and is currently used for an Electronic Toll Collection (ETC) system for a toll road. The DSRC radio system according to ARIB STD-T55 employs millimeter waves (5.8 GHz) for radio communication between a DSRC vehicle device (vehicle communication device) installed on a vehicle and a roadside radio device whose antenna is provided beside a road. Since the power of the millimeter waves is attenuated in a great ratio to distance, each communication area can be formed to be small (approximately 3–30 m). Furthermore, the communication areas are separated individually and therefore radio communication is implemented reliably, since the millimeter waves have a tendency not to leak outside the communication area and not to interfere in the communication area. Further, processing for communication can be performed fast and can be completed while the traveling vehicle stays in the small communication area, since the millimeter waves provide high-traffic communication (1.024 Mbps).

According to the DSRC radio system, the roadside radio device transmits a frame, and the DSRC vehicle device emits a radio wave as a response to the frame mainly based on the Frame Control Message Channel (FCMC). That is, the DSRC vehicle device in the communication area formed by the roadside radio device receives a pilot signal transmitted from the roadside radio device, and transmits a response signal to the roadside radio device. In this way, communication between the vehicle device and the roadside device is performed. Therefore the DSRC vehicle device outside the communication area is in a wait state and does not emit a radio wave.

The DSRC vehicle device is installed on, for example, the dashboard of the vehicle so that it can communicate with the roadside radio device through the windshield of the vehicle. However, if the windshield is made of heat reflecting glass, it includes conducting film inside and therefore has very low radio wave transmittance. When the DSRC vehicle device communicates through such a windshield, failure may occur or it cannot communicate at all. Accordingly, it is required to check radio wave transmittance of the windshield beforehand. Specifically, it is required to determine whether the windshield has sufficiently high radio wave transmittance for the DSRC vehicle device to communicate through the windshield.

The transmittance of the windshield may be checked by actually performing communication between the DSRC vehicle device and the roadside radio device through the windshield. However, it is bothersome to move the vehicle to a place where the ETC system is implemented for checking the transmittance of the windshield before the vehicle is delivered to a user. It is also not realistic to install a roadside radio device in a service or repair shop in which a DSRC vehicle device is installed in the vehicle, since the roadside radio device is relatively large and expensive.

SUMMARY OF THE INVENTION

The present invention has an object to provide a vehicle communication device which is installed in a vehicle and capable of continuously emitting a radio wave through the windshield of the vehicle so that the intensity of the radio wave may be checked by using a commercially available radio wave measuring instrument.

The present invention has another object to provide a device for checking the intensity of the radio wave emitted from the vehicle communication device through the windshield.

The vehicle communication device according to the present invention is installed in a vehicle and communicates with an external roadside radio device using a DSRC radio system. The vehicle communication device can be switched between a normal mode and an emitting mode. The vehicle communication device in the normal mode waits for a pilot signal from the roadside radio device, and transmits a response signal in response to receiving the pilot signal similarly to a conventional vehicle communication device. The vehicle communication device is switched to the emitting mode when a staff in a service or repair shop performs a specific operation. The vehicle communication device in the emitting mode continuously emits a radio wave through the windshield of the vehicle independently of whether it receives the pilot signal from the roadside radio device.

Preferably, the specific operation performed by the staff in a service or repair shop is designed so as to prevent accidental use by a user of the vehicle. For example, this specific operation may be a combination of an operation of control switches provided on the vehicle communication device and an operation of another vehicle device.

The checking device according to the present invention receives the radio wave emitted from the vehicle communication device in the emitting mode, and determines whether the intensity of the received radio wave is greater than a predetermined threshold. The result of the determination is reported to the staff in the service or repair shop. The staff can determine whether the vehicle communication device can be used for an ETC or other DSRC system based on the reported result. The vehicle communication device in the emitting mode is automatically switched to the normal mode when a predetermined time elapses after it is switched to the emitting mode.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
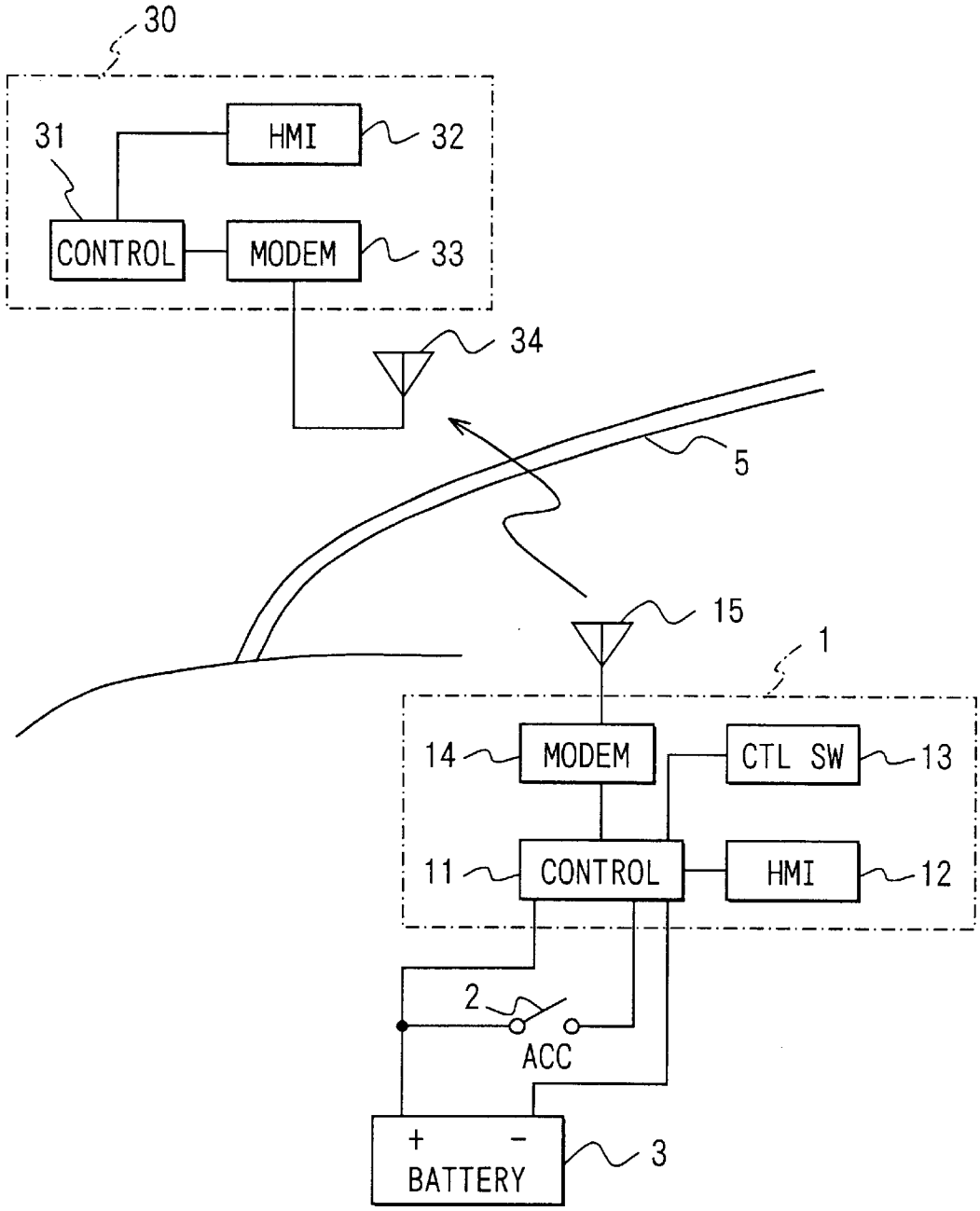
FIG. 1 is a block diagram showing a DSRC vehicle device and a checking device according to an embodiment of the present invention.

Referring to FIG. 1, a DSRC vehicle device 1 includes a control section 11, human-machine interface (HMI) 12, control switches 13, modem section 14, and a DSRC antenna 15. The DSRC vehicle device 1 is connected to a vehicle battery 3 via an accessory switch 2 of an ignition key unit. Further, the DSRC vehicle device 1 includes a card unit which receives an IC card or a magnetic card for paying a toll and reads data from the card or writes data to the card, when the DSRC vehicle device 1 is used for the ETC system.

The control section 11 is formed with a microcomputer or the like, and controls the entire DSRC vehicle device 1. The HMI 12 may include a notification device such as a display and a buzzer to provide audio or visual information for a user. The control switches 13 include at least a forward scroll switch and a backward scroll switch which are used for scrolling user history data displayed by the HMI 12. The modem section 14 modulates a radio wave by the data to be transmitted to a roadside radio device (not shown), and demodulates a radio wave received from the roadside radio device to obtain data.

The DSRC vehicle device 1 can be switched from a normal mode to a radio wave emitting mode by a specific operation using the control switches 13 on the DSRC vehicle device 1 and the accessory switch 2 of the ignition key unit as will be described later.

The DSRC vehicle device 1 is installed in a vehicle, and performs radio communication with the roadside radio device whose antenna is installed in the vicinity of a road. The DSRC vehicle device 1 is arranged on the dashboard of the vehicle in order to facilitate reception of a radio wave from the roadside radio device, and performs radio communication through the windshield 5.

Each roadside radio device forms a communication area of several meters, and communicates with the DSRC vehicle device 1 in the communication area. Specifically, the roadside radio device transmits a pilot signal (FCMC) at predetermined intervals for activating the DSRC vehicle device 1. The DSRC vehicle device 1 in the normal mode receives the pilot signal and, in response to this, transmits a response signal (MDC) to the roadside radio device. The roadside radio device receives the response signal, and then data communication between the roadside radio device and the DSRC vehicle device 1 is performed. In this way, data communication between the roadside radio device and the DSRC vehicle device 1 is entirely controlled by the roadside radio device when the DSRC vehicle device 1 is in the normal mode.

The DSRC vehicle device 1 in the emitting mode continuously emits a radio wave independently of whether it receives the pilot signal from the roadside radio device.

A checking device 30 for checking the intensity of a radio wave is installed in a service or repair shop in which the DSRC vehicle device 1 is installed in a vehicle. It includes a control section 31, a HMI 32, a modem section 33, and a DSRC antenna 34 as shown in FIG. 1. The control section 31 is formed with a microcomputer or the like, and controls the entire checking device 30. The HMI 32 may include a notification device such as a display and a buzzer to provide audio or visual information to the user. The modem section 33 demodulates a radio signal received from the DSRC vehicle device 1 via the DSRC antenna 34 into an electric signal, and forward the electric signal to the control section 31. The checking device 30 includes similar components to the DSRC vehicle device 1. Therefore the checking device 30 can employ the same construction as the DSRC vehicle device 1 for the most part.

The checking device 30 checks the intensity of a radio wave transmitted from the DSRC vehicle device 1 through the windshield 5 as follows in order to determine whether the DSRC vehicle device 1 can be used for the ETC system.

The checking device 30 is arranged at a predetermined distance (e.g., 1 m) from the DSRC vehicle device 1 in the emitting mode so that the windshield 5 is positioned between the checking device 30 and the DSRC vehicle device 1. The checking device 30 is connected to and powered by a 12V battery.

Figure 2:
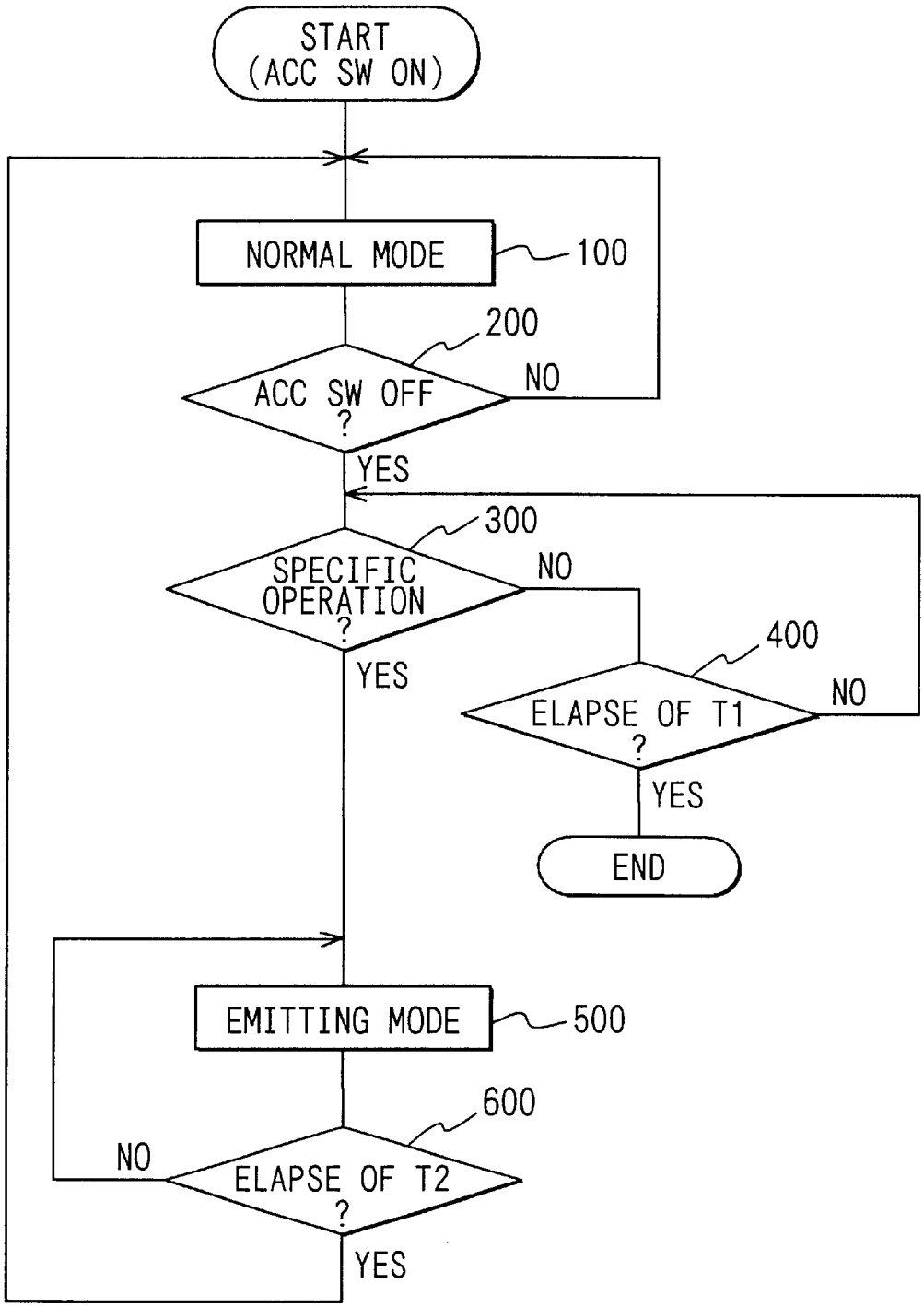
FIG. 2 is a flowchart of the process performed by the DSRC vehicle device.

Referring to FIG. 2, the DSRC vehicle device 1 starts to operate in the normal mode if the accessory switch 2 of the ignition key unit is turned on at step 100. It continues to operate in the normal mode until the accessory switch 2 is turned off. When the accessory switch 2 is turned off (step 200:YES), it is determined at step 300 whether the specific operation is performed. If the specific operation is not performed within a predetermined time T1 after the accessory switch 2 is turned off (step 400:YES), this routine terminates. If the specific operation is performed within the predetermined time T1 (step 300:YES), the DSRC vehicle device 1 is switched to the emitting mode at step 500. The DSRC vehicle device 1 in the emitting mode continuously emits a radio wave and notifies the user via the display or buzzer of HMI 12. The emitted radio wave is used by the checking device 30 for checking its intensity. The DSRC vehicle device 1 continues to operate in the emitting mode during a predetermined time T2. When the predetermined time T2 elapses after the DSRC vehicle device 1 is switched to the emitting mode, this routine returns to step 100, that is, the DSRC vehicle device 1 is switched to the normal mode and continues to operate in the normal mode until the accessory switch 2 is turned off. The predetermined time T1 used at step 400 may be about 2 seconds, and the predetermined time T2 used at step 600 may be about 1 minute.

The specific operation performed at step 300 will now be explained in more detail. Ideally, the intensity of the radio wave emitted from the DSRC vehicle device 1 is only checked by a professional staff in a service or repair shop. Therefore, the specific operation is preferably designed so as to prevent accidental use by a user of the vehicle. Accordingly the specific operation may be a sequence of steps such as, for example:

(i) Turn off the accessory switch 2 (i.e., change the position of the ignition key cylinder) while pressing the forward scroll switch of the control switches 13.

(ii) Turn on the accessory switch 2 within 2 seconds without operating the control switches 13.

(iii) Turn off the accessory switch 2 within 2 seconds without operating the control switches 13.

(iv) Repeat the operations (ii) and (iii) four times.

(v) Turn on the accessory switch 2 while pressing the backward scroll switch of the control switches 13.

If the specific operation is defined as a sequence of steps, it is unlikely that the user would unintentionally switch the DSRC vehicle device 1 from the normal mode to the emitting mode. Further, the DSRC vehicle device 1 may be automatically switched to the normal mode when the predetermined time T2 elapses after the DSRC vehicle device 1 is switched to the emitting mode as shown in FIG. 2. Therefore it is improbable that the user has difficulty when using the DSRC vehicle device 1 for the ETC system or the like after the above checking, even if the user unintentionally switches the DSRC vehicle device 1 to the emitting mode.

The checking device 30 receives the radio wave, which is emitted from the DSRC vehicle device 1 through the windshield 5, via the DSRC antenna 34. The received radio wave has the intensity attenuated according to the radio wave transmittance of the windshield 5. In the checking device 30, the modem section 33 demodulates the received radio signal into an electric signal, which is forwarded to the control section 31. The control section 31 compares the intensity of the received signal with a predetermined threshold. If the intensity of the received signal is greater than the threshold, the staff in the service or repair shop is notified by the display or buzzer of HMI 32. The threshold is determined depending on how far the checking device 30 is arranged from the DSRC vehicle device 1. Therefore the threshold is varied as the predetermined distance between the DSRC vehicle device 1 and the checking device 30 is varied.

The checking device 30 may measure the intensity of the received signal by using a commercially available radio wave measuring instrument such as a power meter. However, such a commercial measuring instrument can typically measure the intensity of the signal with high precision, and therefore is complex and expensive. The checking device 30, however, is not required to measure the intensity of the signal precisely, but is only required to determine whether the intensity of the received signal is greater than the threshold. Therefore the checking device 30 can employ the same construction as the DSRC vehicle device 1 for the most part as described above, so that it is simple and inexpensive.

(Other Embodiments)

(i) In the above embodiment, the staff in the service or repair shop needs to get into the vehicle in order to switch the DSRC vehicle device 1 to the emitting mode using the accessory switch 2 and the control switches 13. However, if the staff outside the vehicle can switch the DSRC vehicle device 1 to the emitting mode by remote control, the staff is not required to get into the vehicle. This may be implemented as follows. The checking device 30 transmits a command to emit a radio wave for a predetermined physical test toward the DSRC vehicle device 1. Such a command is provided in 'ARIB STD-T55'. When the DSRC vehicle device 1 in the normal mode receives the command, it is automatically switched to the emitting mode. Accordingly the DSRC vehicle device 1 is required to have a function of receiving the command for being switched by remote control. If the DSRC vehicle device 1 is set to be switched by remote control, it is unlikely that the user would switch the DSRC vehicle device 1 to the emitting mode by mistake. In addition, the command may be transmitted by a communication means other than the DSRC communication. For example, the command may be transmitted by cable communication such as RS232C, or by using a specific IC card inserted in the IC card interface.

(ii) In the above embodiment, the specific operation is a combination of the accessory switch 2 operation and the control switch 13 operation. However, the specific operation can be defined to be one of the accessory switch 2 operation and the control switch 13 operation. Further, the specific operation may be an operation of a vehicle device other than the DSRC vehicle device, for example, an opening and closing operation of the vehicle door.

(iii) In the above embodiment, the checking device 30 determines whether the intensity of the radio wave is greater than the threshold, and reports the result of the determination to the user of the checking device 30. However, the checking device 30 may also determine which of several intensity stages the radio wave is in. For example, the checking device 30 determines which of three stages the intensity of a radio wave is in by using two thresholds, and reports the result of the determination to the user of the checking device 30. The user may determine that the DSRC vehicle device 1 can be used for an ETC or other DSRC system depending on whether the intensity of the radio signal is equal to or greater than a predetermined level of the three levels.

What is claimed is:

1. A vehicle communication device installed in a vehicle and capable of communicating with an external device through a windshield of a vehicle, wherein the vehicle communication device is switchable between a normal mode and a radio wave emitting mode, wherein the vehicle communication device in the normal mode waits for a pilot signal from a roadside radio device as the external device, and transmits a response signal in response to the pilot signal, and wherein the vehicle communication device in the radio wave emitting mode transmits a radio wave without receiving the pilot signal.

2. A vehicle communication device as set forth in claim 1, wherein the vehicle communication device in the normal mode is switched to the radio wave emitting mode if a specific operation which is at least one of operation of control switches on the vehicle communication device and operation of other vehicle devices is performed.

3. A vehicle communication device as set forth in claim 2, wherein the specific operation is a combination of the operation of the control switches on the vehicle communication device and the operation of the vehicle devices.

4. A vehicle communication device as set forth in claim 2, wherein the operation of other vehicle devices is an operation of changing a position of an ignition key cylinder.

5. A vehicle communication device as set forth in claim 1, wherein the vehicle communication device in the normal mode is switched to the radio wave emitting mode when it receives a command to emit a radio wave for a predetermined physical test from a special device other than the roadside radio device.

6. A vehicle communication device as set forth in claim 1, wherein the vehicle communication device in the radio wave emitting mode is automatically switched to the normal mode when a predetermined time elapses after the vehicle communication device is switched to the radio wave emitting mode.

7. A checking device for checking an intensity of a radio wave emitted from a vehicle communication device in a radio wave emitting mode as set forth in claim 1, the checking device comprising:

a receiving means for receiving the radio wave emitted from the vehicle communication device;

a determining means for determining at least whether the intensity of the radio wave received by the receiving means is equal to or greater than a predetermined threshold; and a reporting means for reporting a result of the determination made by the determining means.

8. A checking device for checking an intensity of a radio wave emitted from the vehicle communication device as set forth in claim 5, the checking device comprising:

a receiving means for receiving a radio wave emitted from the vehicle communication device;

a determining means for determining at least whether an intensity of the radio wave received by the receiving means is equal to or greater than a predetermined threshold; and a reporting means for reporting a result of the determination made by the determining means, wherein the checking device has a function as the special device as set forth in claim 5.

9. A method for checking a vehicle communication device which is installed in a vehicle and starts communication with a roadside device in response to a pilot signal from the roadside device through a windshield of the vehicle in its normal mode, the method comprising the steps of:

providing close to the vehicle an external device for measuring an intensity of a signal received thereby, the external device being separate from the roadside device;

switching forcibly the vehicle communication device from a normal mode to a radio wave emitting mode to emit a signal without the pilot signal from the roadside device;

measuring by the external device an intensity of the signal emitted from the vehicle communication device; and automatically switching the vehicle communication device back to the normal mode from the radio wave emitting mode.

10. A method as set forth in claim 9, wherein the forced switching step switches the vehicle communication device from the normal mode to the radio wave emitting mode if at least one of manual switches on the vehicle communication device and an accessory switch of an ignition key unit of the vehicle is operated.

11. A method as set forth in claim 9, wherein the automatic switching step switches the communication device back to the normal mode after a predetermined time from the forced switching step.

12. A communication device capable of communicating with a radio device, wherein the communication device is switchable between a normal mode and a radio wave emitting mode, wherein the communication device in the normal mode waits for a pilot signal from the radio device, and transmits a response signal in response to the pilot signal, wherein the communication device in the radio wave emitting mode transmits a radio wave outside without receiving the pilot signal from the radio device.

13. A communication device as set forth in claim 12, wherein the communication device in the normal mode is switched to the radio wave emitting mode if at least one of manual switches on the communication device is operated.

14. A communication device as set forth in claim 12, wherein the communication device in the radio wave emitting mode is automatically switched to the normal mode.

* * * * *